US009649239B2

(12) United States Patent
Reyes

(10) Patent No.: US 9,649,239 B2
(45) Date of Patent: May 16, 2017

(54) HYDRAULIC CHAIR WITH POSITIONING APPARATUS

(71) Applicant: Rafael Barajas Reyes, Reno, NV (US)

(72) Inventor: Rafael Barajas Reyes, Reno, NV (US)

( * ) Notice: Subject to any disclaimer, the term of this patent is extended or adjusted under 35 U.S.C. 154(b) by 168 days.

(21) Appl. No.: 14/644,824

(22) Filed: Mar. 11, 2015

(65) Prior Publication Data

US 2015/0257960 A1 Sep. 17, 2015

Related U.S. Application Data

(60) Provisional application No. 61/951,138, filed on Mar. 11, 2014.

(51) Int. Cl.

| | |
|---|---|
| ***A47C 1/03*** | (2006.01) |
| ***A61G 15/02*** | (2006.01) |
| ***A61G 15/12*** | (2006.01) |
| ***A61G 15/00*** | (2006.01) |
| ***A61G 13/12*** | (2006.01) |
| ***A61G 13/06*** | (2006.01) |

(Continued)

(52) U.S. Cl.

CPC ..... *A61G 15/02* (2013.01); *A47C 1/03* (2013.01); *A47C 1/034* (2013.01); *A47C 1/037* (2013.01); *A47C 1/06* (2013.01); *A47C 7/506* (2013.01); *A47C 7/54* (2013.01); *A47C 20/023* (2013.01); *A61G 7/075* (2013.01); *A61G 13/06* (2013.01); *A61G 13/1235* (2013.01); *A61G 15/002* (2013.01); *A61G 15/12* (2013.01)

(58) Field of Classification Search

CPC ..... A61G 15/00; A61G 15/02; A61G 15/005; A61G 15/12; A61G 13/02; A61G 13/04; A61G 13/06; A61G 13/08; A61G 13/10; A61G 13/104; A61G 13/12; A61G 13/1205; A61G 13/1235; A61G 7/075; A47C 1/04; A47C 1/06; A47C 1/10; A47C 1/11; A47C 1/022; A47C 1/03; A47C 1/031; A47C 20/023; A47C 7/004; A47C 7/006; A47C 7/50; A47C 7/506; A47C 7/52; A47C 7/54; A47C 7/546; A47C 3/026

See application file for complete search history.

(56) References Cited

U.S. PATENT DOCUMENTS 3,241,828 A * 3/1966 Adolphson ..... A61G 13/02 5/614
4,136,908 A * 1/1979 Crayne ..... A47C 1/11 297/188.21

(Continued)

*Primary Examiner* — Nicholas Polito
*Assistant Examiner* — David R Hare
(74) *Attorney, Agent, or Firm* — Donald R. Boys; Central Coast Patent Agency, Inc

(57) ABSTRACT

A support chair has a base with wheels, a support post with a translation mechanism, a power system with controls, an upper seat portion having a downward-extending post engaging the support post and engaging the translation mechanism such that the chair portion raises and lowers, a back-support portion hinged to the seat portion, a leg-support portion hinged to the seat portion, a plurality of attachment interfaces implemented to frame elements of the support chair, and at least one multiply-articulated peripheral support assembly having a padded surface at one end and a support interface at an opposite end, the support interface enabled to join to any one of the attachment interfaces implemented to the frame elements.

11 Claims, 13 Drawing Sheets

(51) Int. Cl.

| | |
|---|---|
| ***A61G 7/075*** | (2006.01) |
| ***A47C 20/02*** | (2006.01) |
| ***A47C 7/54*** | (2006.01) |
| ***A47C 7/50*** | (2006.01) |
| ***A47C 1/037*** | (2006.01) |
| ***A47C 1/034*** | (2006.01) |
| ***A47C 1/06*** | (2006.01) |

(56) References Cited

U.S. PATENT DOCUMENTS 5,135,210 A * 8/1992 Michelson ..... A61G 13/12 5/623
5,249,838 A * 10/1993 Kulpa ..... A47C 1/026 248/371
5,653,499 A * 8/1997 Goodall ..... A47C 7/70 297/170
6,106,065 A * 8/2000 Carroll ..... A47C 1/0347 297/325
6,382,725 B1 * 5/2002 Carroll ..... A47C 1/03255 297/302.3
6,772,460 B2 * 8/2004 Heimbrock ..... A61G 1/0243 5/610
7,870,624 B1 * 1/2011 Winston ..... A61G 13/0018 5/610
9,033,088 B2 * 5/2015 Salek ..... B60N 2/00 180/168
2003/0115674 A1 * 6/2003 Heimbrock ..... A61G 13/08 5/617
2006/0225212 A1 * 10/2006 Parson ..... A61G 5/006 5/618
2009/0250565 A1 * 10/2009 Jaggers ..... A61G 13/12 248/125.8
2011/0272976 A1 * 11/2011 Wei ..... A47C 1/022 297/195.11
2012/0056453 A1 * 3/2012 Andoloro ..... A47C 1/026 297/195.11

* cited by examiner

HYDRAULIC CHAIR WITH POSITIONING APPARATUS

CROSS-REFERENCE TO RELATED APPLICATIONS

The present application claims priority to Provisional Patent Application 61/951,138, filed Mar. 11, 2014. All disclosure of the parent application is incorporated herein at least by reference.

BACKGROUND OF THE INVENTION

1. Field of the Invention

The present invention is in the technical field of torso positioning for procedures, such as medical procedures, and pertains more particularly to methods and apparatus for seating and positioning a subject for tattooing procedures.

2. Discussion of the State of the Art

In the field of medical equipment there are hydraulic lift chairs provided for seating and positioning individuals undergoing treatments or other procedures to specific areas or portions of their bodies. Hydraulic lift chairs are known in the art and used for many different service industries, including barber, medical, tattoo, massage, IV treatment, and others. A challenge with current hydraulic chair apparatus is the lack of flexible or adjustable features for providing comfort, ease and advantage for an artist or therapist.

In many cases subjects must assume certain positions to enable access to areas of treatment or service for relatively long periods of time while seated on a chair apparatus that does not entirely support the position assumed. Subjects may be tempted to shift positions because of the discomfort involved in trying to maintain an unsupported position. Also, conventional such equipment is very limited in apparatus and method to support different areas of a human body to advantage. Therefore, what is clearly needed is a hydraulic chair apparatus including at least one body part positioning apparatus that solves the problems stated above.

BRIEF SUMMARY OF THE INVENTION

In one embodiment of the invention a support chair is provided, comprising a base unit having wheels at one end, a vertically-oriented support post, a translation mechanism within the support post, and a power system with controls for powering the translation mechanism, an upper seat portion having a downward-extending post engaging the vertically-oriented support post and engaging the translation mechanism such that the chair portion raises and lowers in response to operation of the controls, a back-support portion hinged at one end of the seat portion and having a latching mechanism enabling orientation of the back-support portion at multiple angles from parallel to the seat portion to vertically upward, a leg-support portion hinged at an end opposite the end hinged to the back-support portion and having a latching mechanism enabling orientation of the leg-support portion at multiple angles from parallel to the seat portion to vertically downward, a plurality of attachment interfaces implemented to frame elements of the support chair; and at least one multiply-articulated peripheral support assembly having a padded surface at one end and a support interface at an opposite end, the support interface enabled to join to any one of the attachment interfaces implemented to the frame elements.

In one embodiment of the invention the controls comprise a first and a second foot switch activating one or more actuators such that activating the first foot switch causes the translation mechanism to extend, raising the upper seat portion, releasing the first foot switch holds the upper seat portion at its raised position, and activating the second foot switch causes the translation mechanism to retract, allowing the upper seat portion to lower until the second foot switch is released. Also in one embodiment the upper seat portion is free to rotate in the vertically-oriented support post of the base portion. In one embodiment the plurality of attachment interfaces implemented to the frame elements comprise square tubing sections fastened to the frame elements and extending outward, and the support interface of the support assembly is a section of square tubing of a size to slide within the square tubing of the attachment interfaces fastened to the frame elements, such that support assemblies may be mounted to the chair at a plurality of places on the chair.

In one embodiment the square tubing sections fastened to the frame elements and the square tubing sections of the support assembly have matching through-holes enabling insertion of a pin at various positions to constrain the tubing sections when joined. Also in one embodiment the support chair further comprises a padded head-support portion attached to the back-support portion at an end away from the hinged end. In one embodiment the padded head-support portion is attached by mechanisms allowing the padded head-support portion to be rotated, extended away from the back-support portion, and to be angled relative to the back-support portion. Also in one embodiment the at least one multiply-articulated peripheral support assembly, having the padded surface at one end and the support interface at the other end, comprises at least four sections, a first section joined to the support interface by a pivot mechanism with an axis allowing the first section to be rotated on a substantially horizontal plane with the peripheral support assemble engaged in one of the plurality of attachment interfaces, a second section joined to the first section by a pivot mechanism having an axis allowing the second section to be rotated in a second plane not parallel to the horizontal plane, a third section joined to the second section by a pivot mechanism having an axis allowing the third section to be rotated in a third plane, and a fourth section joined to the third section by a pivot mechanism having an axis allowing the fourth section to be rotated in a fourth plane, the padded surface joined to the fourth section.

In one embodiment each of the sections comprises a linear arm with a centerline extending at an angle away from the axis of the pivot mechanism at the end closer to the attachment interface. Also in one embodiment the centerline of the arm for at least one of the sections is co-linear with the axis of the pivot mechanism at the end closer to the attachment interface. Also in one embodiment the centerline of the arm for at least one of the sections is orthogonal with the axis of the pivot mechanism at the end closer to the attachment interface.

In another embodiment of the invention individual ones of the pivot mechanisms have mating serrated elements with a clamping mechanism allowing the mechanism to be loosened, rotated to a desired position around the axis, and to be securely clamped to stay in the desired position. Also in one embodiment individual ones of the linear arms comprise a translation mechanism allowing the arm to be extended or shortened in length, and to be secured at a chosen length. And in one embodiment the peripheral support assembly provides from four to ten degrees of freedom in placing and securing the padded surface in a position relative to the support chair.

DETAILED DESCRIPTION OF THE INVENTION

In various embodiments described in enabling detail herein, the inventor provides a unique powered hydraulic lift chair for industries such as the medical and tattoo industry. The present invention is described using the following examples, which may describe more than one relevant embodiment falling within the scope of the invention.

Figure 1:
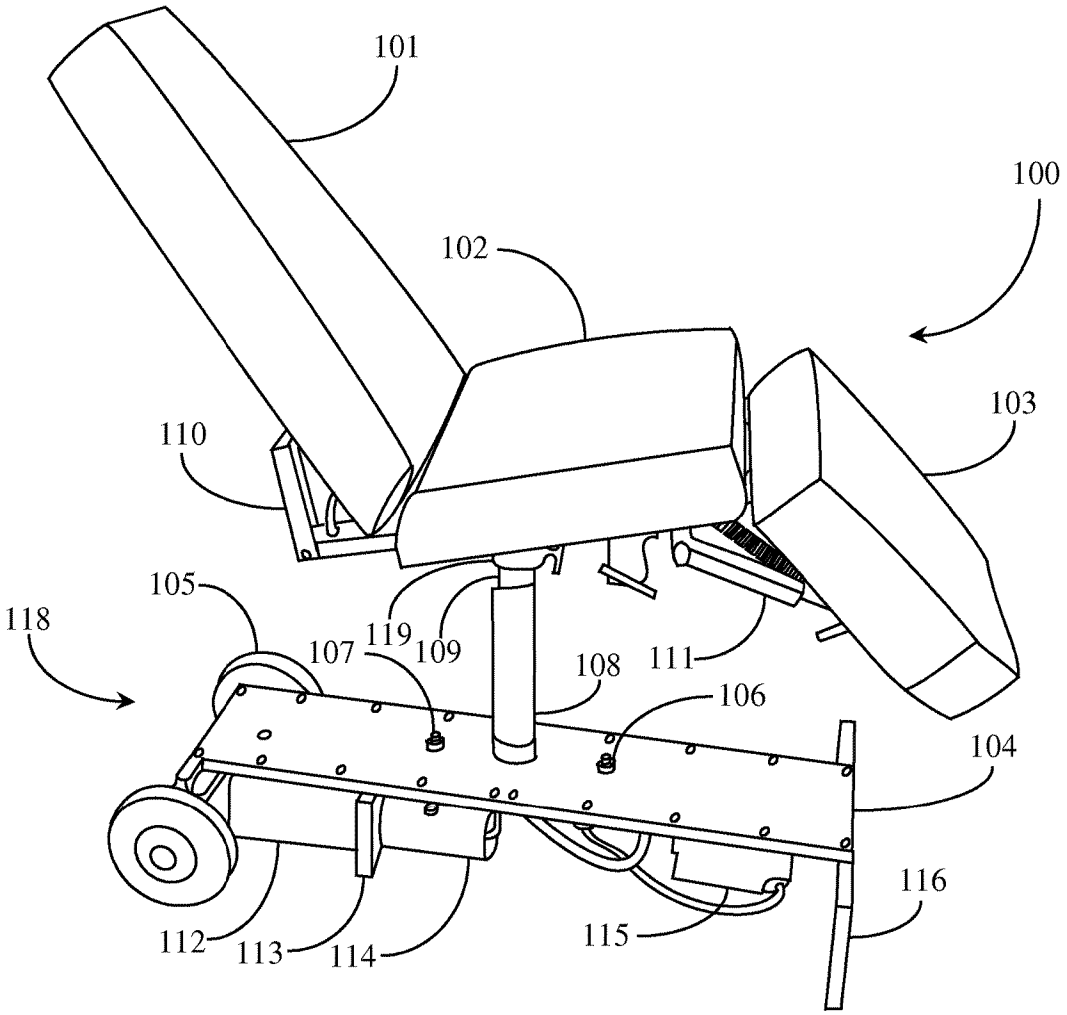
FIG. 1 is a perspective view of a hydraulic chair apparatus according to an embodiment of the invention.

FIG. 1 is a perspective view of a hydraulic chair apparatus 100 according to an embodiment of the invention. Chair apparatus 100 includes a wheeled base station 118. Base station 118 includes a wheelbase 105. Wheelbase 105 includes opposing wheels axially mounted over an axle welded to or otherwise attached to a base plate 104. Base plate 104 in this embodiment includes a support leg (U stand) 116 that is welded or otherwise attached thereto at or near the end of base plate 104 opposite to wheelbase 105. In one embodiment base plate 104, the axle portion of wheelbase 104, and support leg 116 are fabricated of steel. In other embodiments, other durable metals and materials may be considered such as aluminum, polymers, and composite materials used in manufacturing and available to the inventor.

Base station 118 includes a center post 108. A chair post 109 translates vertically inside center post 108, lifted from below by a hydraulic cylinder, not seen in FIG. 1. Center post 108 may be fabricated of steel tubing having an inside diameter large enough to accept the outside diameter of chair post 109, and the outside diameter of the hydraulic cylinder and related components in place within the post to lift the chair portion of apparatus via chair post 109. Post 108 is welded or otherwise installed in an opening provided through base plate 104 and is accessible from the underside of base plate 104. In an alternative embodiment post 108 may be bolted to or welded to base plate 104.

Base station 118 may be operated like a dolly with chair 117 detached from cylinder 108. Support leg 116 functions as a dolly handle allowing for reduced work relative to transporting and positioning chair apparatus 100 for use. The distance from the underside of base plate 104 to ground defines the profile height of base station 118 when station 118 is horizontally positioned on the ground. The overall height is dependent in part on the diameter of the wheels on wheelbase 105 and the length of the support legs of bar 116. The overall height is sufficient to accommodate hydraulic equipment, a power source, and the associated electronics and hydraulic hoses without any of those components touching ground.

In one embodiment a battery, such as battery 115 mounted on the underside of base plate 104, powers hydraulic chair apparatus 100. A fluid tank 112 is provided and mounted to the underside of base plate 104 and connected to a flange 113. A fluid pump motor 114 is provided and mounted to the underside of base plate 104 and connected to flange 113 on the opposite side of fluid tank 112. Flange 113 also serves as a pump and return hose housing (hoses not illustrated here).

The system for driving the hydraulic cylinder in post 108 includes electronic components such as a solenoid, one or more relay switches, and one or more operational switches. In this embodiment two operational switches are provided in the form of foot-activated switches 106 and 107. Switch 106 may be activated to lift chair 117 by providing hydraulic fluid to the cylinder in post 108. Switch 107 may be activated to release fluid through a return line thus reducing the pressure in the cylinder and allowing chair 117 to be lowered under the combined weight of a person and the chair.

In one embodiment there may be a single dual-function switch instead of two single function switches. In still another embodiment there may be a toggle function switch providing lift and lower functions in a single switch. In one embodiment an adjustable valve that regulates the amount of fluid return is provided (not illustrated here) to control the speed of descent when lowering the chair. The average weight of a person sitting in the chair may be a factor considered in valve adjustment. In this embodiment battery 115 is a rechargeable battery and may be connected to a normal AC power outlet via a battery charger unit.

In alternative embodiments there may be a direct AC connection to a wall socket to power the chair, and the circuitry may be arranged to recharge the battery while the chair is plugged in to AC power. The battery then provides power in locations where AC outlets are not available.

Chair 117 may be adjustable in position relative to three chair parts that are hinged together. These are a chair back 101, a chair seat 102, and a chair foot 103. Chair back 101 is hinged to chair seat 102, which in turn is hinged to chair foot 103.

An angularly adjustable back support frame 110 is provided to further connect chair back 101 to chair seat 102. Back support frame 110 may be fabricated of square steel tubing in one embodiment. In another embodiment, aluminum or some other durable metal may be used in place of steel in the fabrication of back support frame 110. Back support frame 110 may be manually adjustable in angular position to recline and advance back chair 101 angularly relative to chair seat 102. The angular range of adjustment of chair back 101 to seat 102 using frame 110 may be from 90 to approximately 180 degrees enabling a person sitting in the chair to sit upright or to recline to a horizontal position. The mechanism of adjustment may be manual with a lock mechanism to secure a particular angular position of chair back 101 relative to seat portion 102. In one embodiment the adjustment may be made using hydraulic or other powered assistance without departing from the spirit and scope of the present invention.

An angularly adjustable support frame 111 is provided to further connect chair foot 103 to chair seat 102. Support frame 111 may be fabricated of square steel tubing in one embodiment. In another embodiment, aluminum or some other durable metal may be used in the fabrication of Support frame 111. Chair foot 103 may be angularly adjusted relative to chair seat portion 102 using a manually operated mechanism connected to frame 111. A range of angular adjustment may be from approximately 180 degrees to approximately 90 degrees in the opposite direction from the back chair relative to seat 102 allowing a subject seated in chair apparatus 117 to sit with the legs down or extended to a relatively horizontal position. The method of angular adjustment of chair foot 103 may be incremental using a pin under spring tension and ladder shelf apparatus mounted to the underside of chair foot 103 and connected to frame 111. More detail about the angular adjustment of chair back 101 and chair foot 103 is provided later in this specification.

Chair apparatus 117 may be freely rotatable about cylinder 108 and may be locked into a particular rotation angle using a mechanically operated locking collar and handle, such as a spring loaded or threaded T-handle provided on a locking collar 119. In one embodiment chair apparatus 117 includes one or more armrests that may be mounted and positioned relative to the position of a seated subject. Such armrests may be installed and removed for convenience and may be positioned, when installed, to provide optimal access to a clinician such as a tattoo artist for working on the arm, forearm, etc.

Figure 2:
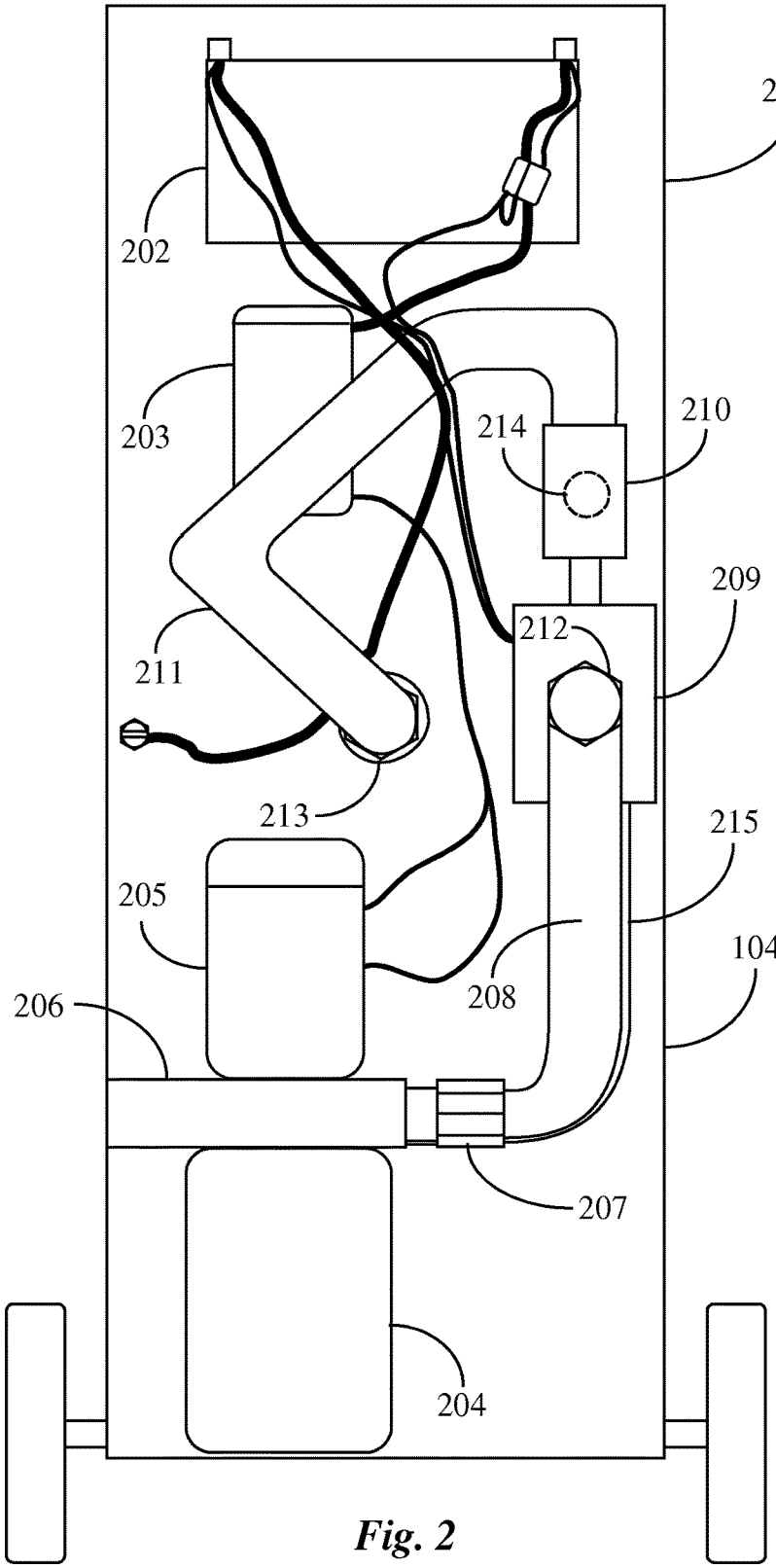
FIG. 2 is a bottom view of the wheeled base station of the chair apparatus of FIG. 1.

FIG. 2 is a bottom view of the wheeled base station of the chair apparatus of FIG. 1. The underside of wheeled base station 118 is depicted to show basic hydraulic components provided for lifting and lowering chair apparatus 117 relative to base station 118. In this view wheels are depicted for reference only. Station 118 includes a hydraulic pump system including a hydraulic fluid reservoir 204, a flange apparatus 206, and a hydraulic pump 205. Hydraulic reservoir 204 may be mounted to the undersurface of base plate 104 using conventional mounting apparatus such as bracket and bolts, for example. Hydraulic reservoir 204 may be fabricated of stainless steel or similar durable materials. Reservoir 204 is mounted to flange 206. Flange 206 functions as a seal and as the housing for a hydraulic fluid pump line 208 and a hydraulic fluid return line 215 situated beneath the pump line. Hydraulic pump motor 205 is mounted to flange apparatus 206 on the other side of reservoir 204 and has pump access to reservoir 204.

A battery 202 in this embodiment provides power for hydraulic lift. Battery 202 may be a conventional 12-volt battery. Battery 202 may have a relatively thin profile to facilitate mounting beneath base plate 104 so as not to come in contact with the ground when base station 118 is in a horizontal position on the ground or floor. The negative terminal of battery 202 is connected to ground (base plate 104) for safety. A conventional solenoid switch 203 is provided and connected to battery 202 and mounted to the underside of base plate 104 by conventional mounting apparatus such as a bracket and bolts. Solenoid 203 is electrically connected to pump motor 205 and to foot-operated up and down switches 106 and 107 described further above relative to FIG. 1.

A pump line hose 208 and fittings (212, 207) are provided to lift chair apparatus 117 to a desired height. A return line 215 with return line fittings (not visible) is provided to return fluid back into reservoir 204 during chair descent operations. The pump and return line hoses are connected from flange apparatus 206 to a solenoid-operated valve housing 209. Valves are provided within valve housing 209 to control pump line operation when the chair apparatus is being lifted and to control fluid return operation when the chair apparatus is being lowered. A mechanically operated flow valve 210 is provided to regulate the speed of ascent and descent of the chair apparatus (117) while operating. Flow valve apparatus may be mechanically adjusted via a fluid flow adjustment knob 214 accessible from the backside of the flow valve 210. Valve 214 may be turned in one direction to restrict fluid flow and in the opposite direction to relax fluid flow into hydraulic cylinder 108. In one embodiment two flow valve knobs may be provided, one for restricting or relaxing the flow of pump line fluid into the hydraulic cylinder and one for restricting or relaxing return line fluid going back into reservoir 204.

A bi-directional hydraulic line hose 211 is connected from the mechanical flow valve 210 to the hydraulic cylinder in center post 108 through base plate 104, and is secured by a fitting 213. Conventional hydraulic seals may be used where required to maintain the integrity of the hydraulic system for lifting and lowering the chair apparatus. In one embodiment flow restriction valve 210 is an automatic valve that may be controlled by an electronic switch and sensors to adjust the speed of lift and decent relative to the weight of a person sitting in the chair. In one embodiment the valve is electronically operated with a manual override switch enabling manual adjustment.

In operation, an operator may activate foot switch 106, for example, causing a power connection from the battery to pump motor 205. In one embodiment the switch is activated by foot pressure to raise the chair apparatus the apparatus continuing to rise while foot pressure is applied to the switch. In this aspect, the pump may be turned off when the operator releases foot pressure from the switch. The amount of table rise is controlled by the amount of time the operator applies force to switch (106). In another aspect the switch is dually operated where the operator activates the switch to start lift and then reactivates the switch to stop lift. In this aspect switch (107) may be activated to start descent and then reactivated to stop decent. The speed of ascent and decent may be controlled by flow knob 214 controlling valve flow valve 210.

In one embodiment battery 202 may be electrically charged using a conventional battery charger. In one embodiment chair apparatus 117 is detachable from station 118 and station 118 may be stood upright using fold out legs or "kick stands" to position it vertically during maintenance operations. An operator may transport base station 118 like a dolly using u-bar 116 as a dolly handle and rolling the station about on the wheels. In one embodiment the wheels in wheelbase 105 are lockable to prevent unintended rolling.

Figure 3:
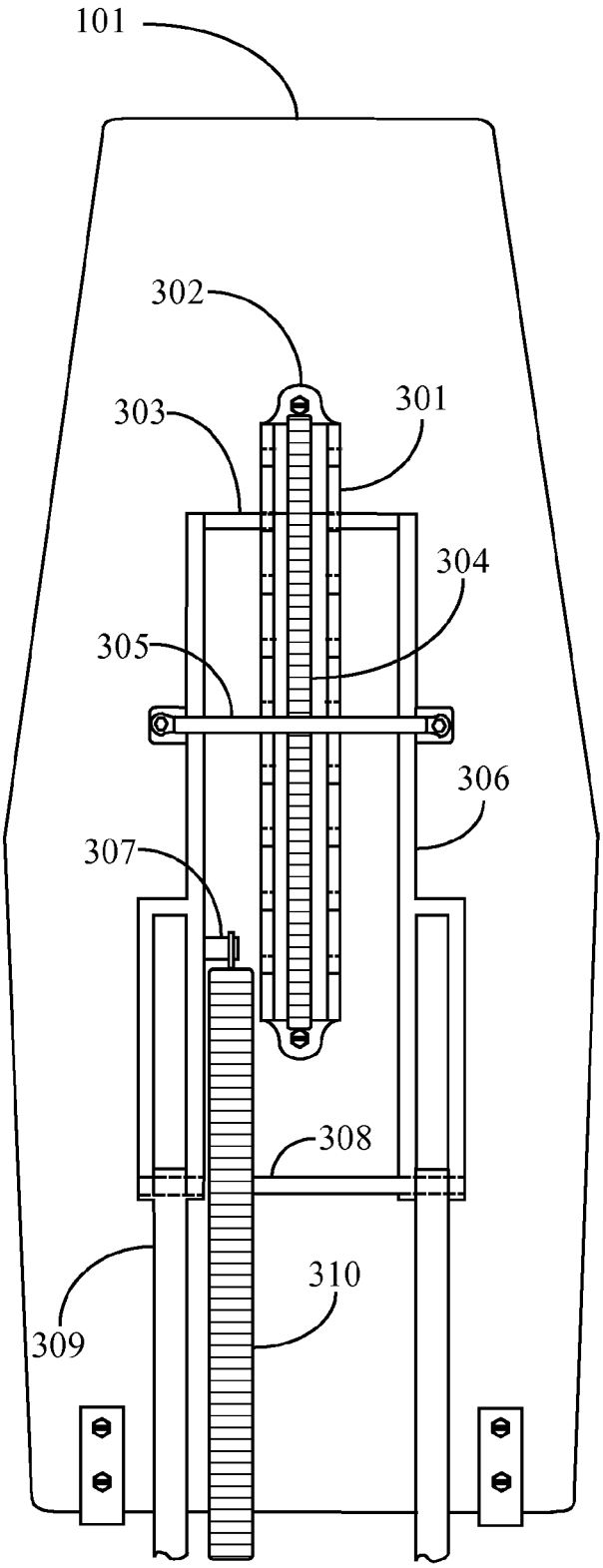
FIG. 3 is a rear elevation view of the chair back of the chair apparatus of FIG. 1.

FIG. 3 is a rear elevation view of the chair back of the chair apparatus of FIG. 1. Chair back 101 is depicted in elevation view to show the underside of the chair back including angular adjustment apparatus and frame connection. Chair back 101 includes a vertically-oriented ladder-shelf 301. Ladder shelf 301 has a back mounting plate and two sidewalls that include multiple pin shelf positions (nine in this example). Ladder shelf 301 may be mounted to the back of chair back 101 using conventional hardware at two or more mounting positions 302 (one on each end). Ladder shelf 301 may be fabricated from steel, aluminum, or other durable metals or materials without departing from the spirit and scope of the present invention.

A pin shelf position is defined as a horizontal shelved position of a horizontal pin via symmetrical slots machined into the sidewalls of the ladder shelf. In this example, a ladder pin 303 is provided and attached between members of a frame 306. Frame 306 may be fabricated of steel tubing or rod that may be welded together to form the frame. In one embodiment the tubing or rod used to fabricate the frame is square or rectangular. Frame 306 is rotatably pinned to frame members 309 of frame 11 described further above in FIG. 1 via a stainless steel frame pin 308. Frame pin 308 may be permanently or removable installed through aligned openings provided through appendages of frame 306 and through frame members 309 without departing from the spirit and scope of the present invention.

Shelf ladder 301 includes a retainer spring 304. Retainer spring 304 is installed over shelf ladder 301 orthogonally relative to the pin shelves. In this example, spring 304 is bolted at the same positions as the shelf ladder. Retainer spring 304 is adapted in this embodiment to retain pin ladder 303 in a shelf position on shelf ladder 301. Retainer spring 304 may be a standard stainless steel spring with stiff spring resistance. Frame element 306 includes a handle 305. Handle 305 is adapted as a gripping handle for an operator to hold when adjusting the angular position of chair back portion 101 relative to chair seat portion 102. Handle 305 may be fabricated of steel rod or another durable material. Handle 305 is welded to or otherwise attached to frame 306. It will be apparent to the skilled person that the functions of these mechanisms may be accomplished in a number of other ways, with other well-known mechanisms.

Frame 306 includes a spring attachment pin 307. A second spring 310 is provided to maintain tension between frame 306 and frame 111. One end of spring 310 is attached to pin 307 on frame element 306 while the other end of the spring is attached to a spring attachment pin 513 depicted on frame member 309 in FIG. 5 described further below. Spring 310 provides tension between frame 306 and frame 111, which includes frame members 309.

An operator working with chair apparatus 100 may grab handle 305 on the back of chair back 101 and physically pull pin 303 out of a current shelf position for repositioning at another shelf position thereby changing the angle of tilt for chair back 101 relative to seat 102. The lowest shelf position provides the greatest angle of tilt while the top-most shelf position provides the smallest angle of tilt to near horizontal. Retention spring 304 prevents ladder pin and frame 306 from falling away from the ladder shelf while adjustments are made. Hinge elements at the bottom of the view are illustrated for reference only.

Figure 4:
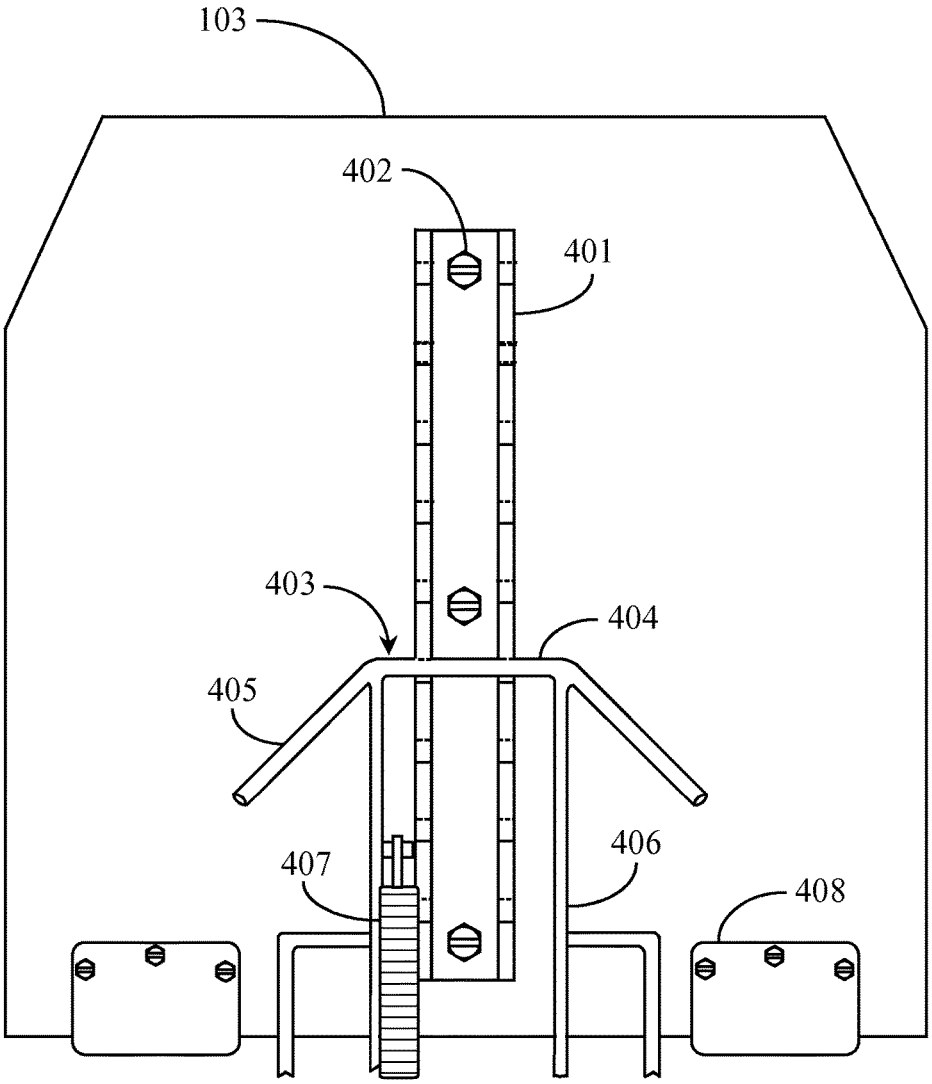
FIG. 4 is a rear elevation view of the chair foot of the chair apparatus of FIG. 1.

FIG. 4 is a rear elevation view of the chair foot of the chair apparatus of FIG. 1. Chair foot 102 is depicted in elevation view to show the underside of the foot including angular adjustment apparatus and frame connection. Chair foot 103 includes a vertically oriented ladder-shelf 401. Ladder shelf 401 is similar to ladder shelf 301 described further above and has a back mounting plate and two sidewalls that include multiple pin shelf positions (nine in this example). Ladder shelf 301 may be mounted to the back of chair foot 103 using conventional hardware at two or more mounting positions 402 (one on each end and one in middle). Ladder shelf 401 may be fabricated from steel, aluminum, or other durable metals or materials without departing from the spirit and scope of the present invention.

Chair foot 103 includes a pin handle apparatus 403. Apparatus 403 serves has a handle via handlebars 405 and as angular position retainer device via pin or cross member 403. Cross member 404 may be disposed on one of the shelf positions on shelf ladder 401. Handle bar 403 is welded on the end of frame 406 and is a rigid part of the frame. Frame 406 is attached at the end opposite handle 403 to frame members of frame 111 discussed further above. The method of attachment is freely rotatable using a frame pin (not illustrated here) installed between frame members 406 and frame posts or members of frame 111 described further above in FIG. 1.

Frame 406 and handle 403 may be fabricated of steel and then welded together to form the frame. A stiff grade steel spring 407 is provided in this example to serve as a tension spring between frame 406 and frame members 111 further described above. Spring 407 is connected to a spring-mounting pin 408 at one end and to a spring mounted pin 502 depicted further below in FIG. 5.

In use, an operator may lift chair foot 103 while grabbing and moving handle 403 out of a shelf position on ladder shelf 401. Spring 407 provides spring tension to help urge pin 404 into the desired shelf position on the ladder shelf. The opposite end of frame 406 is rotatably pinned to frame elements of chair seat 102.

Figure 5:
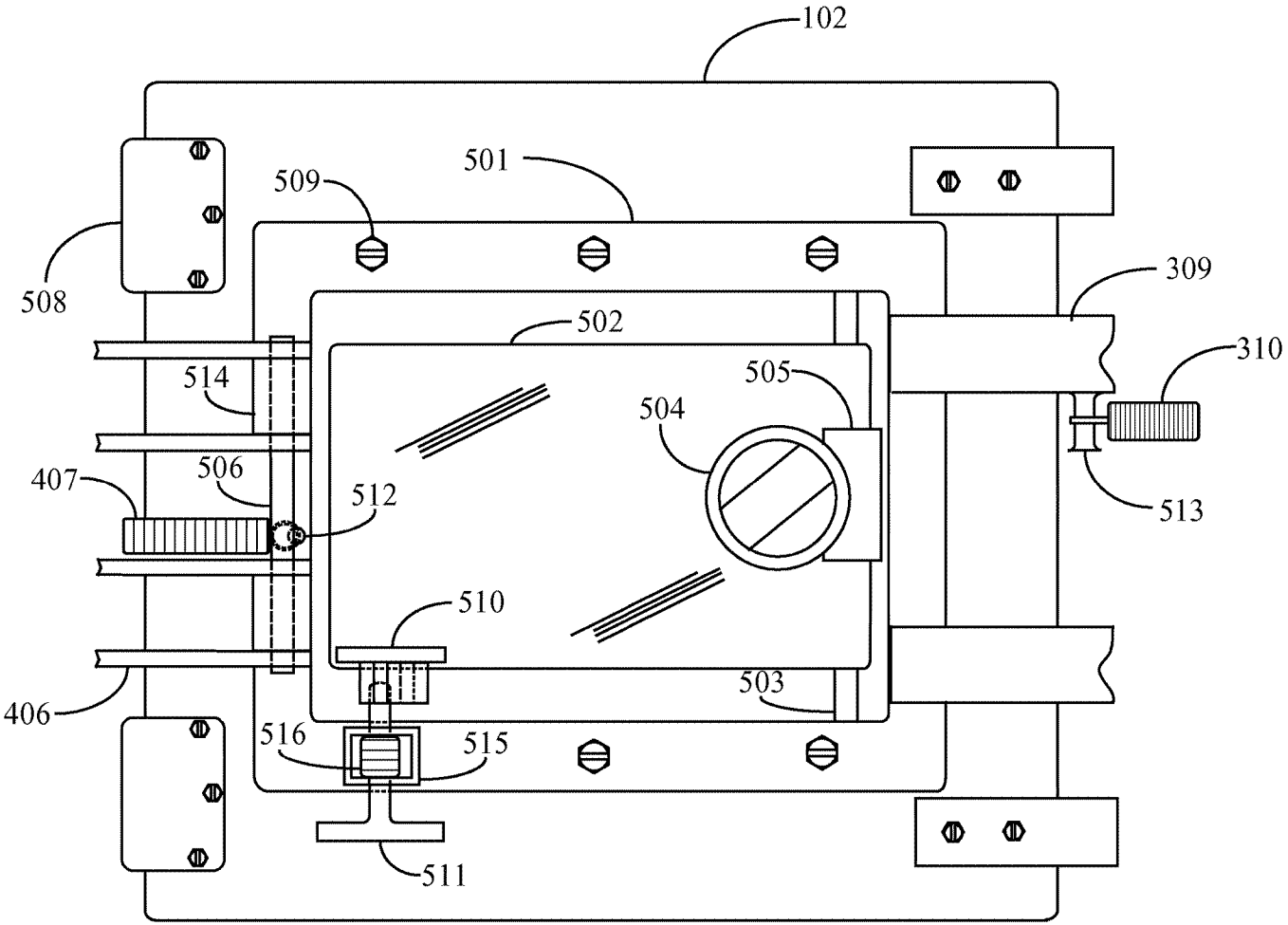
FIG. 5 is a rear elevation view of the chair seat of the chair apparatus of FIG. 1.

FIG. 5 is a rear elevation view of the chair seat of the chair apparatus of FIG. 1. Seat 102 is depicted in elevation view showing the hardware elements mounted to the underside of the seat. Seat 102 includes a rectangular frame 501. Frame 501 provides a connection point for frame elements 406 of FIG. 4, which are analogous to frame 111 of FIG. 1. Frame 501 also provides a connection point for frame elements 309 of FIG. 3, which are analogous to frame 110 of FIG. 1. Rectangular frame 501 may be fabricated from stainless steel rectangular tubing or similar durable metals. Frame 501 may be bolted to the underside of seat 102 using conventional hardware, in this example, bolts 509. Frame 501 supports two upright frame posts 514. Frame posts 514 are welded or otherwise attached to frame 501 in an upright position. Frame posts 514 functions as an installation point for connecting frame 406 in a rotatable fashion to chair seat 102. Frame 406 is rotatably pinned to posts 514 via a pin 506 inserted through aligned openings provided through the frame posts and proximal to the ends of frame 406.

Spring 407 is attached to a spring pin 512 welded or otherwise attached to frame 501. The opposite end of spring 407 is attached to pin 408 as viewed in FIG. 4. Seat 102 is also hinged to chair foot 103 using a conventional piano type hinge in this example. Frame 501 also supports frame elements 309 that are rotatably pinned via pin 308 to frame 306 of FIG. 3. Frame elements 309 may be welded or otherwise attached to frame 501. Spring 310 is attached to frame element 309 at a spring attachment pin 513. The opposite end of spring 310 is attached to spring pin 307 as viewed in FIG. 3.

Seat 102 includes a pivot plate 502. Pivot plate 502 may be fabricated of stainless steel or another durable metal or material. Pivot plate 502 is rotatably pinned to frame 501 via a pin 503 inserted through an opening provided through or otherwise formed on the underside of the plate. Pivot plate 502 includes a latch plate 505 that may function to latch or otherwise secure pivot plate 502 to pin 503. Pin 503 extends into frame 501 at both ends.

In one embodiment, pivot plate 502 may be pivoted up from flush orientation with frame 501 and locked in one or more alternate positions defined by a locking plate 510 and a spring tensioned T-Handle 511. Locking plate 510 may be fabricated from stainless steel or another metal and is welded or otherwise rigidly attached to the top surface of pivot plate 502. Locking plate 510 includes two or more recesses of sufficient inside diameter to accept the pin portion of T-handle 511. The range of pivot for pivot plate 501 is defined by the location of the recesses on locking plate 510. T-handle 511 is inserted horizontally through an upright post 515 welded to or otherwise attached to frame 501. T-handle 511 and post 515 may be fabricated of stainless steel or other durable metals or materials.

Pivot plate 501 functions in one embodiment as a seat for chair apparatus (117). A post collar 504 is provided and welded or otherwise attached to pivot plate 502. Post collar 504 has an inside diameter of sufficient dimension to accept post 109 of FIG. 1. Post collar 504 has an outside diameter of sufficient dimension to be inserted into locking collar 119 of FIG. 1. Chair apparatus (117) may be freely rotatable about post (119) and may be locked into position using the T-handle of locking collar (119). Collar 119 may be welded onto the end of post or ram 109 or otherwise rigidly attached thereto.

In this embodiment, seat 102 may be pivoted from horizontal to assume an angle defined by the two or more recesses provided in locking plate 510 using T-handle 511 to lock the plate into the desired position. The range of pivot may be from horizontal to approximately 20 degrees in the direction of pivot, which is in the direction of chair back 101. Therefore, seat 102 may be pivoted back from horizontal up to 20 degrees or more depending on the parameters of locking plate 510. This may result in more elevation for chair foot 103, which supports the legs of a subject sitting in the chair apparatus. In another embodiment of the invention there may be removable and adjustable armrests that can be attached to or removed from the structure of the tattoo chair.

Figure 6:
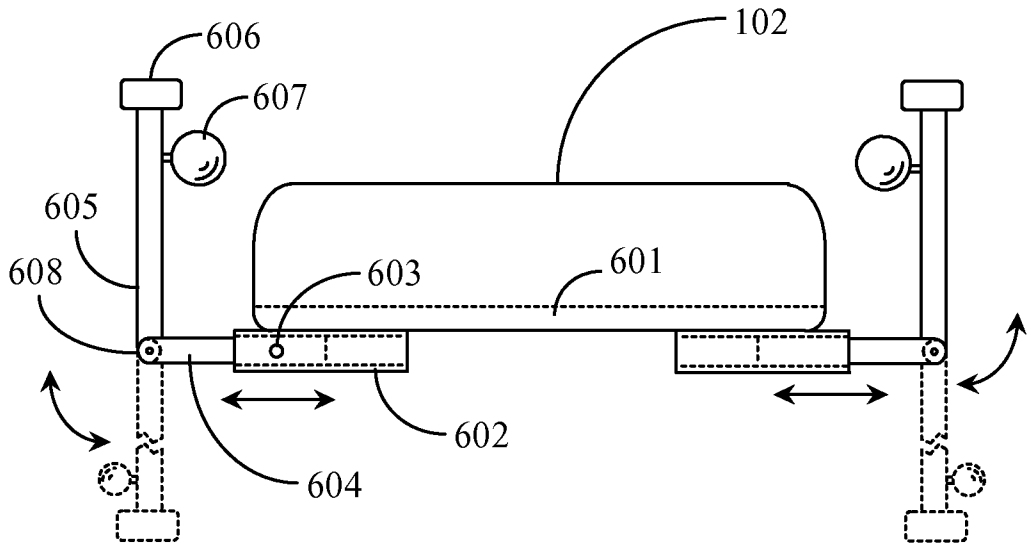
FIG. 6 is a front view of chair seat 102 with foot 103 and back portion 101 removed.

FIG. 6 is a front view of chair seat 102 with foot 103 and back portion 101 removed. Seat portion 102 has a base which may be metal, to which a piece of square steel tubing is attached, one on each side, such as by common fasteners. These instances of steel tubing allow for smaller cross-section square tubing 604 to be inserted into tubing 602, and may be positioned at different distances from the chair seat and fixed in position by insertion of a pin 603 through the two pieces of tubing. In addition tubing 602 may be mounted at an angle to the side edges of seat 102 to extend at an angle either forward or backward with the sides of the seat.

Vertical risers 605 in one embodiment, which may also be fabricated of square steel tubing, may be attached to extensions 604, in some embodiments with a pivoted joint 608, so that padded armrests 606 may be placed to support a subject's arm. Pivot 608 allows armrests to be rotated down to below extensions 604 when not needed, as shown in dotted and broken view in FIG. 6. Armrests may be secured in the up or down position in any one of several ways known in the art. Padded arm rests 606 may be attached to risers 605, and ball elements 607 may be attached at various positions for a person to grip when tattoos are in progress. It will be apparent to the skilled person that there are a variety of ways that armrests may be fabricated and joined to the chair structure, and the descriptions here are indicative of one particular embodiment, of which there may be many. In particular, multiply articulated armrests are shown in later figures and described below, which may be interfaces to the chair at the same square tubing interfaces as described above.

Figure 7:
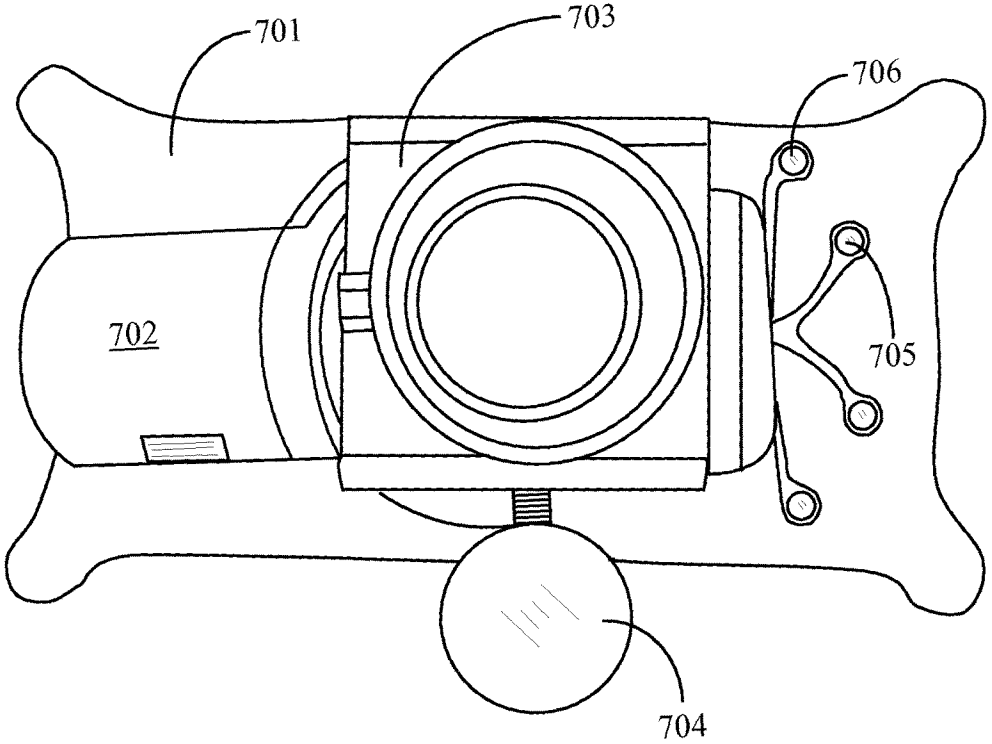
FIG. 7 is an illustration of an existing barbers' chair with the chair portion removed.

FIG. 7 is an illustration of an existing barbers' chair with the chair portion removed. Because there is no good off-the-shelf tattoo chair available on the market, many tattoo practitioners buy old barbers chairs to use as tattoo chairs. The problem with this is that the old barbers' chairs lack the innovative features of the present invention. The inventor discovered that the old barbers' chairs typically have the same bold pattern. Referring to FIG. 7, an existing older barbers' chair is illustrated comprising hydraulic controls 705 and 706, motor 702, plug 703 and base 701. The inventor has discovered an innovative interface 703 that enables the adaptation of the older hydraulic pump, hydraulic ram, base and motor of an older chair to be used with the innovative chair of the present invention.

Figure 8:
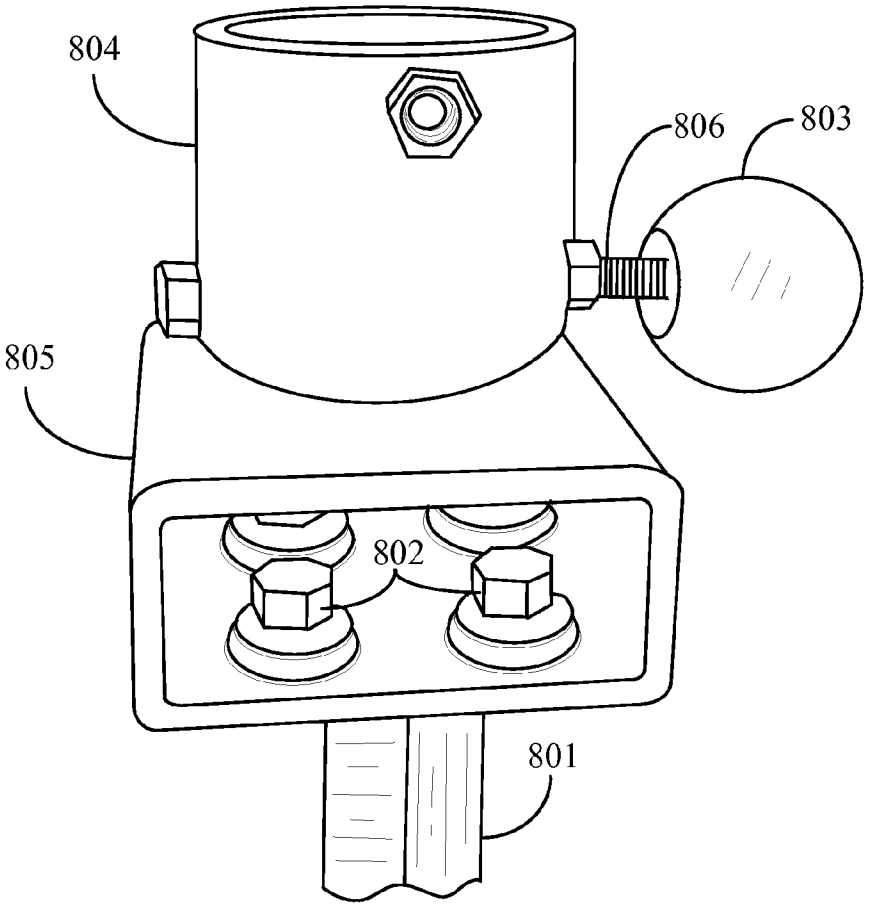
FIG. 8 is a side view of the innovative interface combining older existing barbers' chairs base with the innovative chair of the present invention.

FIG. 8 is a side view of the innovative interface combining older existing barbers' chairs base with the innovative chair of the present invention. Tubular member 804 is affixed to square tubing member 805. Member 805 is adapted to bolt onto existing ram 801 of the older barbers' chair via bolts 802. Post collar 504 (FIG. 5) of the innovative chair of the present invention is lowered onto member 804 of FIG. 8. The post collar is tightened via bolt 806 and knob 803.

Figure 9:
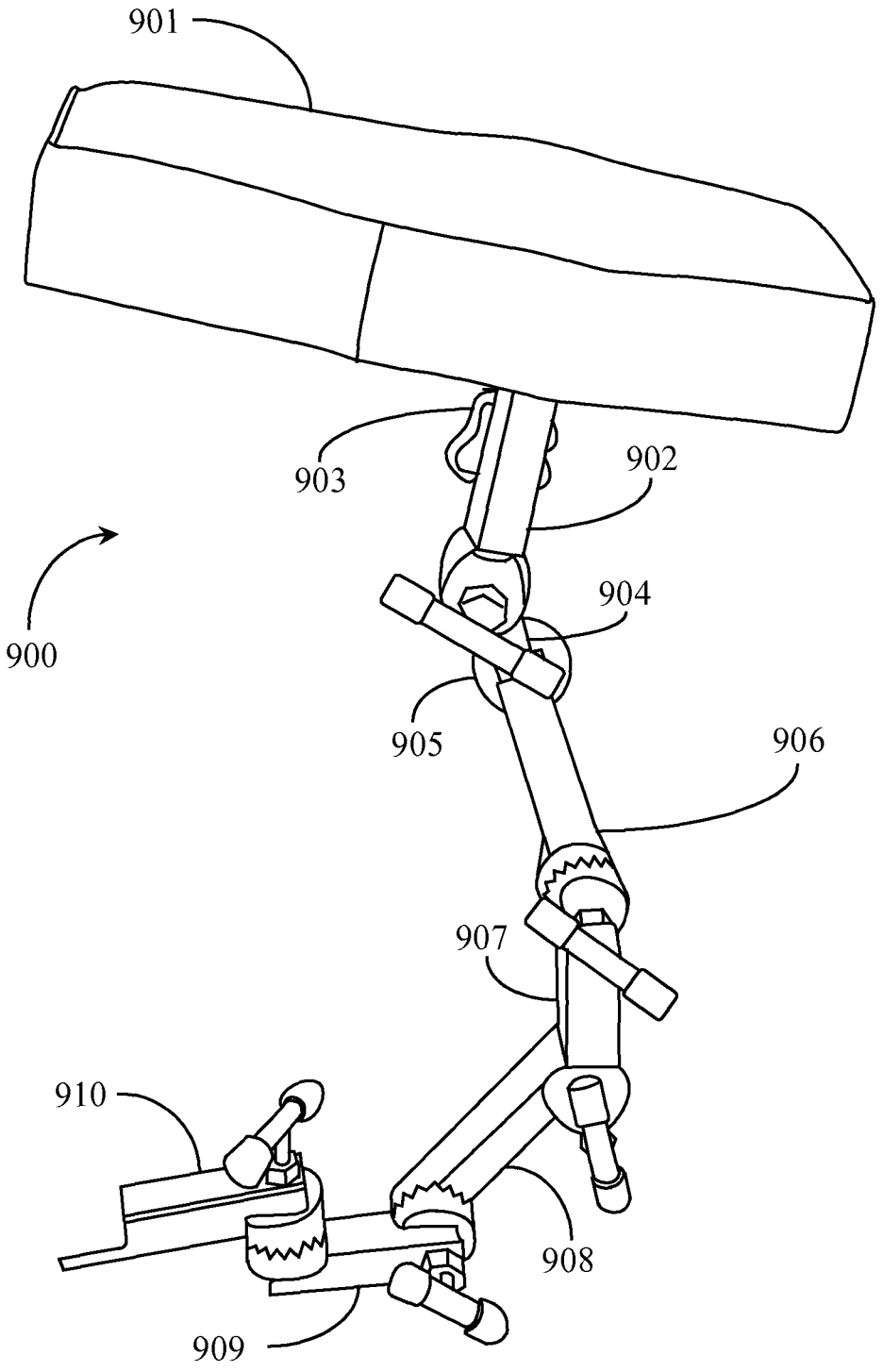
FIG. 9 is a perspective view of an articulating rest platform according to an embodiment of the present invention.

FIG. 9 is a perspective view of a multiply articulated jointed arm rest apparatus 900 according to an embodiment of the present invention. Arm rest apparatus 900 comprises a platform 901, which may be padded, and may be provided in a variety of thicknesses, sizes, padding options and the like. A mechanically-operated extension arm of multiple jointed sections to support pad 901 is shown assembled to an extension and positioning component 910 of the assembly. Platform 901 may be rectangular in shape or a variety of other shapes for supporting certain parts of the body of a subject during, for example, having a tattoo accomplished by a tattoo artist. Typically speaking the most common body part supported by platform 8901 may be a subject's arm. However, this should not be construed as a limitation to practice of the invention as other body parts of a subject may be supported, such as the subject's feet, leg or head in different positions.

Like other soft components of chair 100 described further above, platform 901 may be a stuffed and upholstered piece with a metal or other durable backing (not illustrated) for supporting assembly. Platform 901 may be stuffed with a soft fill material for comfort, such as foam, soft pellets, or other materials designed to provide comfort to a subject.

Arm rest assembly 900 in this embodiment includes an articulated extension arm (assembled from individual sections) that is mechanically operable to enable adjustment of length or elevation of the platform and angular position of platform 901 relative to a seated subject. Platform 901 has a backing that supports a post 902 fixed orthogonally to the underside of the platform in a sufficiently centered position on the underside of the platform for weight distribution. Post 902 in this embodiment is made of rectangular metallic square tubing. Post 902 is adapted to accept an annular member having a diameter just smaller than the inside diameter of the square tubing. The annular member just mentioned is not visible in this view and has a fixed connection at one end (non inserted end) to one half of a rotary cap joint. The annular member is secured within post 902 with a screw and handle apparatus 903 threaded through the side wall of post 902.

The other half of the rotary joint assembly just below the platform includes a second annular member 904 fixed to the second half of the rotary cap joint just described. The rotary caps are adapted to fit together to form an adjustable connection between the two sections having the annular members. Annular member 904 is adapted to fit into an extension section 906 made of the square tubing. A ball handle 905 having a screw post is provided and threaded through the side wall of section 906 in order to secure annular member 904 therewithin. This particular configuration just below the platform is adapted to provide at least 180 degrees of angular adjustment of the platform relative to a horizontal plane.

The cap joint comprises two annular caps of same size dimensions with the open rim of each cap supporting gear teeth that are of a spacing angle and depth so as to fit into one another when the rimmed edges of the cap are placed together. A T-handle having a threaded post is inserted through the center of the cap joint and added lock nuts aid to enable secure tightening of the cap joint at a desired angle along the plane of tooth integration. In one embodiment a section of the extension arm has one half portion of the cap joint welded thereto and has a threaded handle for securing an annular member such as member 904. Other sections have caps welded at both ends for joining with other extension sections to form the extension arm.

The extension arm assembly includes an extension section 907. Extension section 907 comprises a square tube cut to length with two halves of the cap joint welded thereto at opposing ends of the tubing. In one embodiment the cap joint halves are welded in a same orientation, for example, the caps facing the same direction. However, other sections such as extension section 909 include caps welded to both ends but one is welded 90 degrees offset from the other to achieve freedom of angular adjustment horizontally and vertically. In this example, an extension section 909 is provided with just one joint end wherein the opposite end of the section may be block welded or otherwise fixed to a utility such as chair 100 of FIG. 1 or to any solid structure close enough to the seated position of the subject.

In this embodiment the arm extension sections are manufactured of steel square tubing and the cap joints are manufactured from steel annular tubing with annular back plates welded to one end to close off the end not supporting gear teeth. Other types of available rotary joints may be used without departing from the spirit and scope of the present invention. The inventor provides steel sections and joints for the purpose of durability and weight support at the platform. Each joint in the arm extension includes a threaded T-handle and nut configuration to lock the joints together at a desired angle or rotation. To adjust an angle of rotation at a joint the operator may loosen the joint by turning the T-handle to a point where the interfacing teeth of the joint halves may be disengaged. The operator may then rotate the sections to acquire the desired angle and may retighten the joint by turning the T-handle to lock the teeth together at a new angle.

It will be apparent to the skilled person that the articulated arm assembly allows in this embodiment provides at least six degrees of freedom, tilt angle from vertical around in 360 degrees, and rotation in multiple planes. Essentially any desired position of rest 901 for supporting a body part of a subject may be attained.

Figure 10:
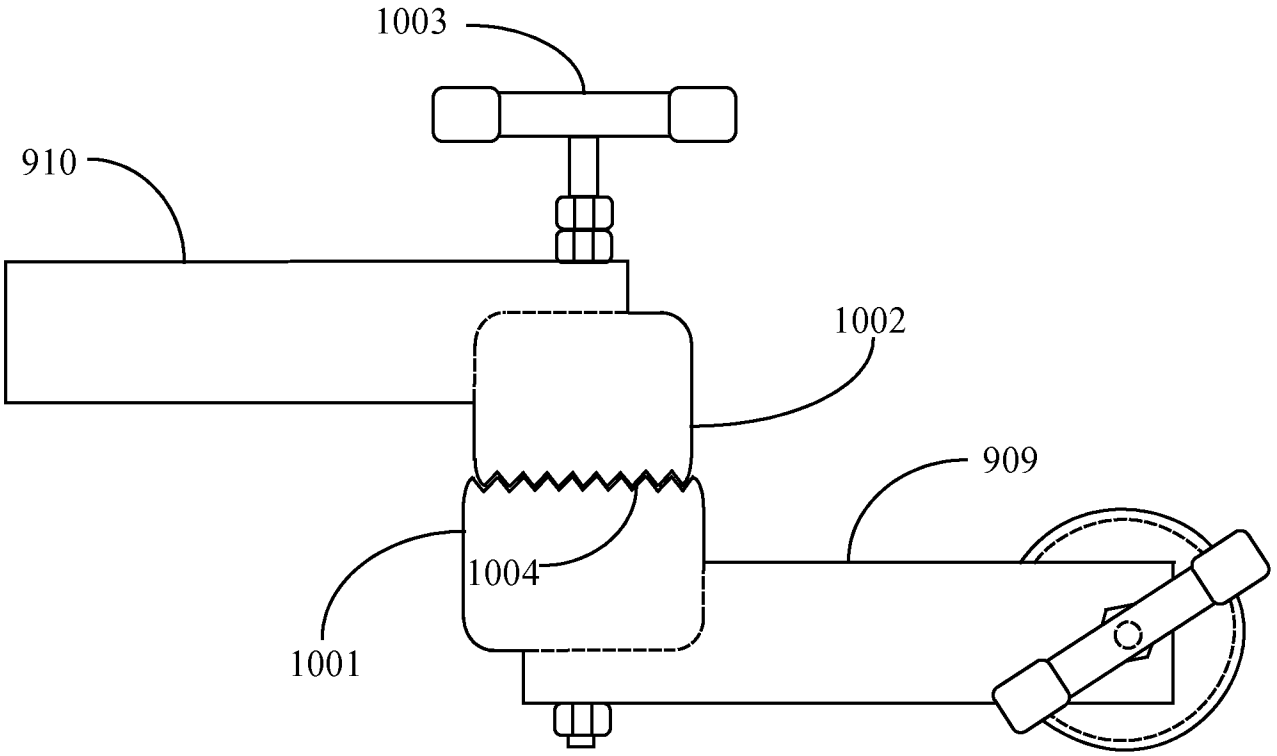
FIG. 10 is an elevation view of connective components of the articulating arm portion of the articulating rest platform of FIG. 9.

FIG. 10 is an elevation view of connective components of the jointed extension arm portion of the arm rest platform of FIG. 9. In this view, extension section 910 is illustrated in a position to be joined to section 909. The square tubing portion of section 910 may be fixed to a structure such as a chair bench or other support structure in the vicinity of the seated subject. Section 910 includes cap 1002 facing downward in this example. Section 909 has two caps one welded at each end. In this configuration cap 1001 joins with cap 1002 and is locked in the desired angular position using T-handle 1003. The mated gear tooth pattern is represented herein as pattern 1004.

Section 909 includes a cap welded at the unsecured end that is ninety degrees offset from cap 1001 in orientation. Therefore a next section may be added with vertical rotational abilities in adjustment. In this view the T-handles and cap joints are identically operated and are interchangeable. In this way an extension arm may be built using fewer or more sections of differing configurations to attain the desired elevation and angle of position of the platform relative to the seated subject. In this view a nut is visible at the opposite surface of the square tube of section 909. In another embodiment the nut at the far end may be recessed within the tube and stopped by the back wall of the cap joint if provided.

Figure 11:
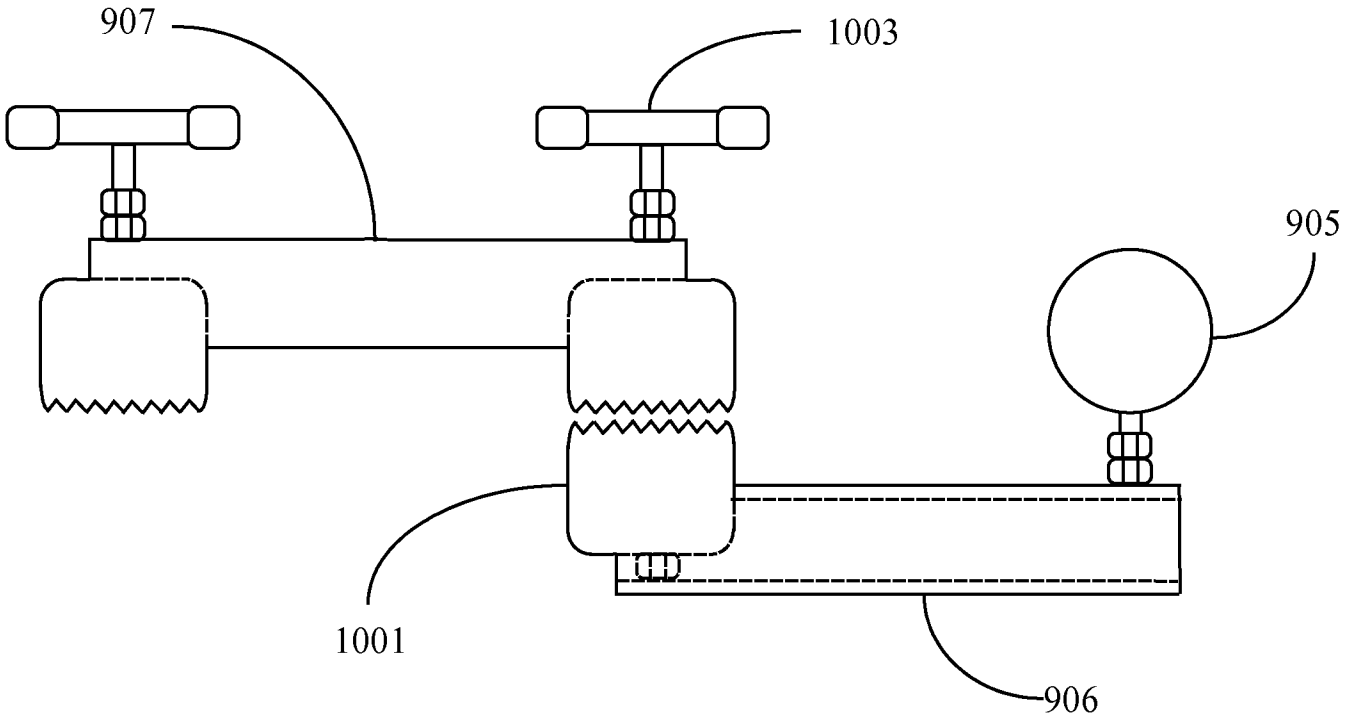
FIG. 11 is an elevation view of additional connective components of the articulating rest platform of FIG. 9.

FIG. 11 is an elevation view of additional connective components of the jointed arm rest platform of FIG. 9. Extension section 907 has a cap welded at both ends wherein the caps face the same direction and function more or less as a length extender. Therefore, this section may be added multiple times to attain certain length of the extension arm and height for the platform. T-handle 1003 is used to tighten the cap joints to secure the sections together at the desired angles.

Section 906 includes one half of the cap joint and is adapted with a ball handle 905 and threaded post inserted through one wall of the tubing section to secure an annular member of another type of section used just below the platform. The ball may be a stainless steel ball with a threaded opening to accept the post. The threaded post may be welded at the opening in the ball to ensure that the ball handle does not become unthreaded from the post.

Figure 12:
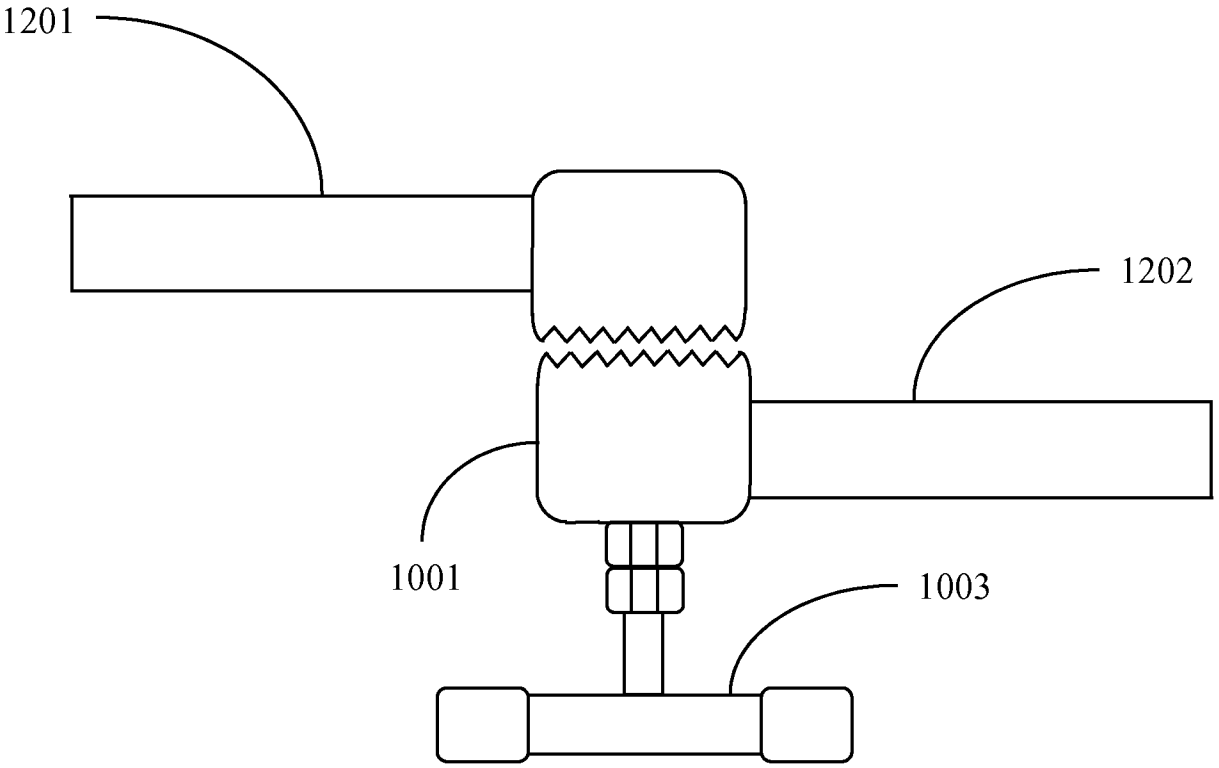
FIG. 12 is an elevation view of additional connective components of the articulating arm of FIG. 9.

FIG. 12 is an elevation view of additional connective components of the jointed arm rest platform of FIG. 9. In this view, the extension sections immediately below the armrest platform depicted in a position to be jointed together. Extension section 1201 includes an annular post fixed to a cap (1001). Both caps forming the cap joint are given the same element number 1001. The annular post of section 1201 is just smaller in diameter than the square tubing of section 906 described above. The post portion is secured within section 906 of FIG. 11 using ball handle 905.

Extension section 1202 also includes an annular post fixed to cap (1001). Extension section 1202 includes a T-handle 1003 and threaded post to lock the sections together at the cap joint. The annular post portion of section 1202 fits into the square tubing of post section 902 of FIG. 9 and is secured in place by handle 903. In one embodiment, extension section 1201 and 1202 are identical and T-handle 1003 might be installed through either cap 1001 of the cap joint. The annular posts in these extension sections may be made from steel, aluminum, polymer, or other durable materials. In one embodiment the posts are steel and are welded to the caps.

Figure 13:
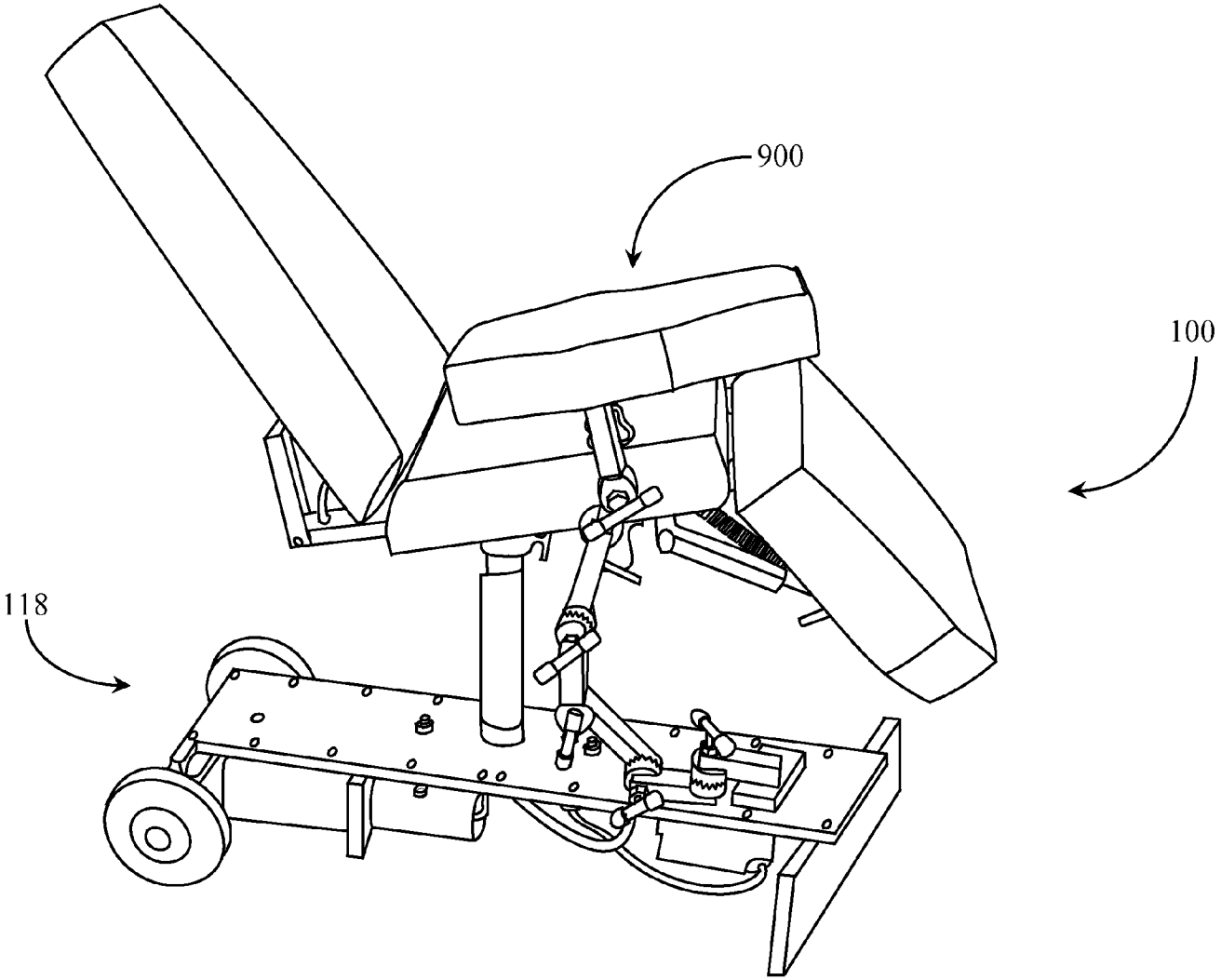
FIG. 13 is a perspective view of the articulating rest platform of FIG. 9 integrated with chair 100 according to an embodiment of the invention.

FIG. 13 is a perspective view of the jointed arm rest platform 900 of FIG. 9 integrated with chair 100 according to an embodiment of the invention. Platform extension 900 may be secured to any solid structure relatively close to a seated subject, for example, undergoing a process such as receiving a tattoo. In this embodiment, armrest extension platform 900 is block welded to the steel base plate of chair 100 of FIG. 1. In this example the extension platform is positioned on the right side of the chair. In another embodiment, the apparatus may be lowered and positioned over to the left side of the chair without completely disassembling the apparatus.

The armrest platform might be removed and replaced with a platform of another configuration such as a head rest or chin rest platform. The apparatus may be elevated further by adding more extension sections. Platform extension 900 may be welded or otherwise fixed to the back frame of chair 100 or on the frame beneath the seat portion of the chair instead of at the base plate without departing from the spirit and scope of the invention. In several preferred embodiments of the invention square tubing interfaces such as those illustrated in FIG. 6 and described relative to FIG. 6 may be provided in a variety of places attached to the framing for the chair of the invention, and articulated arm assemblies as shown in FIGS. 9 and 10 may be interfaced at these places.

It will be apparent to one with skill in the art that the system of the invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

It will also be apparent to the skilled person that the arrangement of elements and functionality for the invention is described in different embodiments in which each is exemplary of an implementation of the invention. These exemplary descriptions do not preclude other implementations and use cases not described in detail. The elements and functions may vary, as there are a variety of ways the hardware may be implemented and in which the software may be provided within the scope of the invention. The invention is limited only by the breadth of the claims below.

The invention claimed is:

1. A support chair comprising:

a base unit having wheels at one end, a vertically-oriented support post, a translation mechanism within the support post, and a power system with controls for powering the translation mechanism;

an upper seat portion having a downward-extending post engaging the vertically-oriented support post and engaging the translation mechanism such that the chair portion raises and lowers in response to operation of the controls;

a back-support portion hinged at one end of the seat portion and having a latching mechanism enabling orientation of the back-support portion at multiple angles from parallel to the seat portion to vertically upward;

a leg-support portion hinged at an end opposite the end hinged to the back-support portion and having a latching mechanism enabling orientation of the leg-support portion at multiple angles from parallel to the seat portion to vertically downward;

a first spring for maintaining tension between the upper seat portion and the back-support portion;

a second spring for maintaining tension between the upper seat portion and the leg-support portion;

a plurality of attachment interfaces implemented to frame elements of the support chair; and at least one multiply-articulated peripheral support assembly having a padded surface at one end and a support interface at an opposite end, the support interface enabled to join to any one of the attachment interfaces implemented to the frame elements;

wherein the at least one multiply-articulated peripheral support assembly, having the padded surface at one end and the support interface at the other end, comprises at least four sections, a first section joined to the support interface by a first pivot mechanism with an axis allowing the first section to be rotated on a substantially horizontal plane with the peripheral support assembly engaged in one of the plurality of attachment interfaces, a second section joined to the first section by a second pivot mechanism having an axis allowing the second section to be rotated in a second plane not parallel to the horizontal plane, a third section joined to the second section by a third pivot mechanism having an axis allowing the third section to be rotated in a third plane, and a fourth section joined to the third section by a fourth pivot mechanism having an axis allowing the fourth section to be rotated in a fourth plane, the padded surface joined to the fourth section; and wherein individual ones of the pivot mechanisms have mating serrated elements with a clamping mechanism allowing the mechanism to be loosened, rotated to a desired position around the axis, and to be securely clamped to stay in the desired position.

2. The support chair of claim 1 wherein the controls comprise a first and a second foot switch activating one or more actuators such that activating the first foot switch causes the translation mechanism to extend, raising the upper seat portion, releasing the first foot switch holds the upper seat portion at its raised position, and activating the second foot switch causes the translation mechanism to retract, allowing the upper seat portion to lower until the second foot switch is released.

3. The support chair of claim 1 wherein the upper seat portion is free to rotate in the vertically-oriented support post of the base portion.

4. The support chair of claim 1 wherein the plurality of attachment interfaces implemented to the frame elements comprise square tubing sections fastened to the frame elements and extending outward, and the support interface of the support assembly is a section of square tubing of a size to slide within the square tubing of the attachment interfaces fastened to the frame elements, such that support assemblies may be mounted to the chair at a plurality of places on the chair.

5. The support chair of claim 4 wherein the square tubing sections fastened to the frame elements and the square tubing sections of the support assembly have matching through-holes enabling insertion of a pin at various positions to constrain the tubing sections when joined.

6. The support chair of claim 1 further comprising a padded head-support portion attached to the back-support portion at an end away from the hinged end.

7. The support chair of claim 6 wherein the padded head-support portion is attached by mechanisms allowing the padded head-support portion to be rotated, extended away from the back-support portion, and to be angled relative to the back-support portion.

8. The support chair of claim 1 wherein each of the sections comprises a linear arm with a centerline extending at an angle away from the axis of the pivot mechanism at the end closer to the attachment interface.

9. The support chair of claim 8 wherein the centerline of the arm for at least one of the sections is co-linear with the axis of the pivot mechanism at the end closer to the attachment interface.

10. The support chair of claim 8 wherein the centerline of the arm for at least one of the sections is orthogonal with the axis of the pivot mechanism at the end closer to the attachment interface.

11. The support chair of claim 8 wherein individual ones of the linear arms comprise a translation mechanism allowing the arm to be extended or shortened in length, and to be secured at a chosen length.

* * * * *